US006702328B2

(12) United States Patent
Malleis et al.

(10) Patent No.: US 6,702,328 B2
(45) Date of Patent: Mar. 9, 2004

(54) SNOWBOARD ACCESSORY AND METHOD FOR ENGAGING BOOT WITH BINDING

(76) Inventors: Joseph A. Malleis, 712 N. 68th St., Seattle, WA (US) 98103-5320; Laurence L. Malleis, 712 N. 68th St., Seattle, WA (US) 98103-5320

( * ) Notice: Subject to any disclaimer, the term of this patent is extended or adjusted under 35 U.S.C. 154(b) by 36 days.

(21) Appl. No.: 09/810,699

(22) Filed: Mar. 15, 2001

(65) Prior Publication Data

US 2002/0024212 A1 Feb. 28, 2002

Related U.S. Application Data

(63) Continuation-in-part of application No. 09/374,564, filed on Aug. 13, 1999, now abandoned.

(51) Int. Cl.[7] ..... A63L 11/00

(52) U.S. Cl. ..... 280/809; 280/637; 280/814; 280/14.21

(58) Field of Search ..... 280/809, 14.21, 280/814, 816, 819, 826, 637, 622, 14.27, 619, 623, 633; 441/70, 75, 73

(56) References Cited

U.S. PATENT DOCUMENTS

| | | | | |
|---|---|---|---|---|
| 2,933,324 A | * | 4/1960 | Stimler | 280/637 |
| 2,959,424 A | | 11/1960 | Richards | 280/11.35 |
| 3,448,989 A | | 6/1969 | Marker | 280/11.35 |
| 3,994,511 A | | 11/1976 | Gronseth | 280/614 |
| 4,479,785 A | * | 10/1984 | Tugwood et al. | 403/78 |
| 5,026,088 A | * | 6/1991 | Stuart | 280/14.22 |

OTHER PUBLICATIONS

Sims Snowboards, *Sims Snowboarding 99–00 Link Binding Systems; p. 20 and p. 21.*

K2 Snowboards, *Shimano Snow Technologies 1998–1999 season, Clicker step–in systems; p. 28 and 29.*

Ride Snowboards, *Ride Snowboards, Conventional Bindings 1999; p. 16 and 17.*

*Primary Examiner*—Brian L. Johnson
*Assistant Examiner*—J. Allen Shriver
(74) *Attorney, Agent, or Firm*—Graybeal Jackson Haley LLP

(57) ABSTRACT

A binding and boot engagement system for use with a snowboard having a step-in binding system is disclosed. The system has a flexible tether connectable at one end to the snowboard and at the other end to the user. When a user is in an elevated lift and has one boot removed from a binding, the user may apply an upward force to the tether, thereby causing the board to elevate. By positioning the free boot over the binding and applying the upward force, the boot is caused to engage with the binding. Features of the invention include having first and second portions of the tether wherein the first portion is generally non-stretchable and the second portion is resiliently connected to the user. In this configuration, a slight tension is usually present in the system, thereby decreasing the chances for unintentional engagement of the system with undesirable objects such as lift equipment or mountain hazards. To further enhance safety, the aforementioned two portions are connected by way of an escapement connector that separates upon encountering sufficient force. Further features include the use of a snowboard anchor to facilitate attachment of the leash to the board and attachment of anti-theft devices when the snowboard is unattended.

(List continued on next page.)

16 Claims, 6 Drawing Sheets

U.S. PATENT DOCUMENTS 5,194,026 A * 3/1993 Corwin et al. ..... 280/637
5,324,220 A * 6/1994 Stewart ..... 119/770
5,564,729 A * 10/1996 Gomez et al. ..... 280/637
5,653,467 A * 8/1997 Griffin et al. ..... 280/809
5,791,297 A * 8/1998 Mudge ..... 119/865
5,820,155 A * 10/1998 Brisco ..... 280/14.24
5,902,164 A * 5/1999 Shoemaker ..... 242/379.2
5,904,056 A * 5/1999 Ozaki ..... 70/18
5,951,048 A * 9/1999 Slaughter ..... 280/637
6,089,592 A * 7/2000 Negus ..... 280/11.36
RE36,800 E * 8/2000 Vetter et al. ..... 280/618
6,290,260 B1 * 9/2001 Brill ..... 280/809
2002/0024212 A1 * 2/2002 Malleis et al. ..... 280/809
2002/0030333 A1 * 3/2002 Graham ..... 280/14.27

* cited by examiner

FIG. 2
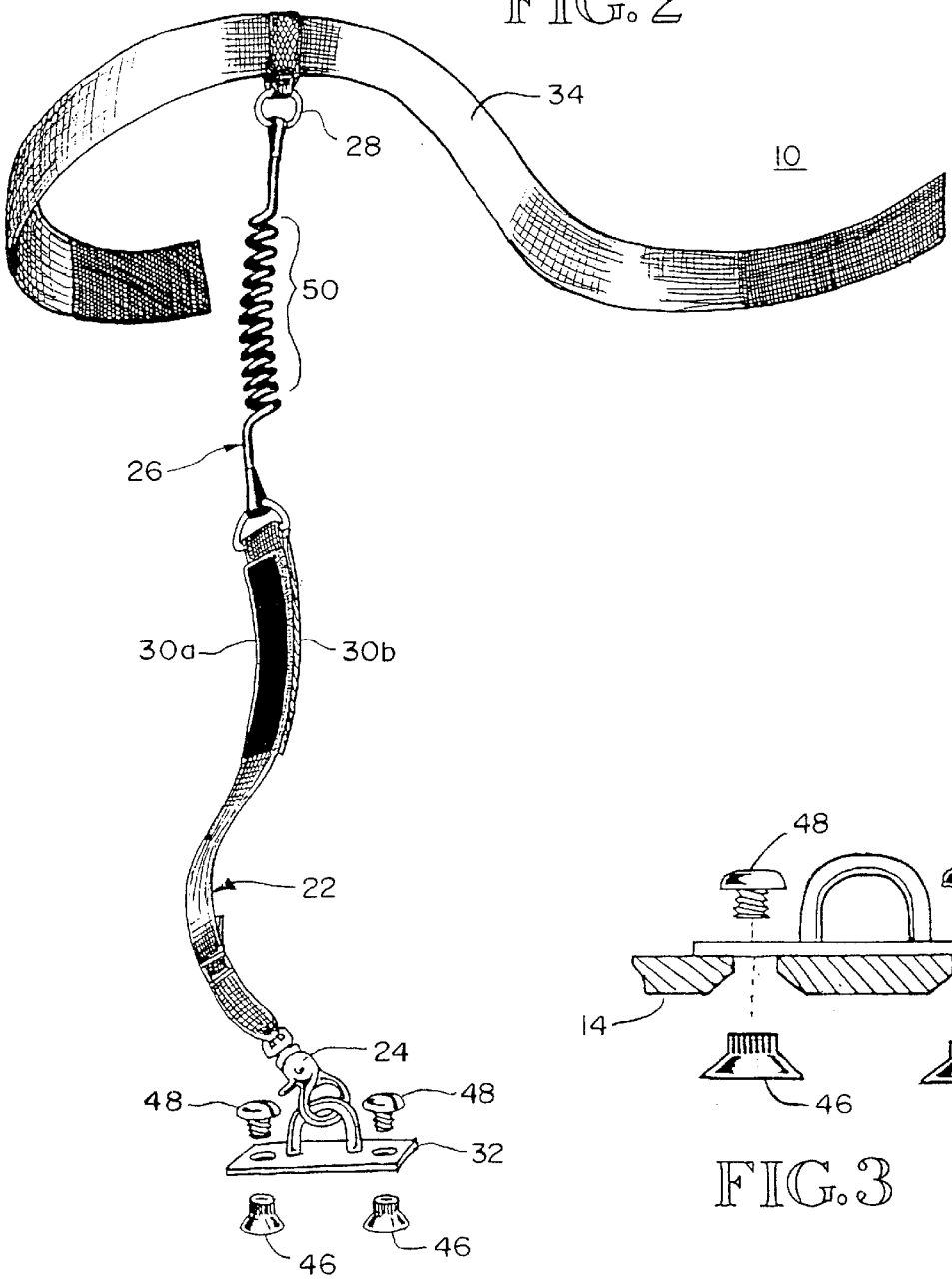
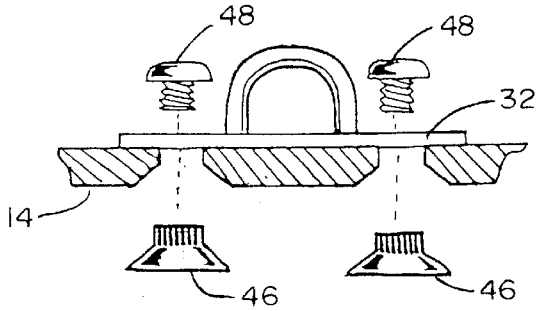
FIG. 3

SNOWBOARD ACCESSORY AND METHOD FOR ENGAGING BOOT WITH BINDING

This is a Continuation-In-Part of application Ser. No. 09/374,564 filed on Aug. 13, 1999 now abandoned, for which benefit is claimed under 35 USC §120.

FIELD OF THE INVENTION

The present invention relates to a snowboard accessory and method for releasably engaging a user with a snowboard, and more particularly to an assisting device for permitting a user to provide an upward bias to a snowboard so that the user may engage a boot with a snowboard binding without having to rely upon a snowboard support surface.

BACKGROUND OF THE INVENTION

For many years, winter snow sports have comprised essentially alpine and Nordic skiing. These disciplines relied on a pair of skis that were removably linked to the user and included a binding system for this purpose. Advances in alpine equipment, for example, lead to the use of step-in bindings. The primary convenience advantage of step-in bindings was to permit the user to engage the ski with the boot without having to significantly manipulate the binding: if the boot was removed properly, the binding would be poised to accept a boot when the user "stepped into" the binding. Similar approaches have been taken with respect to other sports wherein the user is removably linked to the sport equipment, e.g., bicycling.

While the step-in binding and metal glass ski were among the more notable advances in alpine or downhill snow sports, the first truly revolutionary paradigm shift occurred with the introduction of snowboards. In contrast with alpine skiing, the user is linked to a single gliding platform as opposed to two independent platforms (one for each foot). Moreover, the nature of the platform is quite different—a snowboard is generally shorter than alpine skis for a given person and is generally wider than an alpine ski by a factor of 250% to 350%. Another notable distinction, especially over monoskis, is the boot and body position of the user—the user is usually facing at a 45 to 90 degree angle compared to the intended direction of glide. Nevertheless, the construction and mechanics of both are generally similar: use of fiberglass, resins, and metal sheets to form the body of the boards; use of metal edges to enhance performance on hard surfaces; and bindings to engage a specialty boot worn by the user with the board.

As with any new and developing sport, there are bound to be improvements. In the approximately 25 years since Jake Burton, Chuck Barfoot, and Tom Sims introduced snowboards into downhill snow sports, there have been significant improvements with respect to board designs and shapes, selection of materials, types of boots, and types of bindings. In the field of bindings, the most notable improvement has been the introduction of step-in bindings. While sharing similar convenience improvements with its alpine kin, the dynamics involved with snowboards have dictated different design approaches.

The introduction of the snowboard step-in binding was particularly desirable since snowboarders do not have accessories for self-propulsion such as ski poles used by alpine and Nordic skiers. Moreover, because snowboarders are limited to a single gliding platform, they cannot rely upon "skating" (skating is a divergence of the skis to form an extension point with one ski whereby the skier can project forward, and glide on the other ski, and then carryout the process with the other leg) for self-propulsion as alpine and Nordic skiers can. Consequently, snowboarders are relegated to disengaging one foot from the board and using it as the means for self-propulsion. Consequently, and unlike alpine and Nordic skiers, snowboarders are constantly engaging and disengaging one foot from the board. In particular, this event occurs when entering a ski lift line.

A scenario encountered by all snowboarders is to complete a run, glide into the lift line, disengage one boot from the board, propel the board to the lift with the free leg, and use the lift (whether surface lift or chair lift). If a chair lift is being used, it is often times difficult or impossible to re-engage the free boot with the snow board until after leaving the lift equipment and offload area. With the widerspread usage of step-in bindings on snowboards, the difficulty may be less prevalent, however, there is generally very little time to re-engage and adjacent skiers or boarders may not make it feasible to do so. Consequently, the snowboarder has only one boot engaged with the snowboard during the offload operation. And since most offload stations have a declined ramp to assist in removing skiers and boarders from the immediate offload area, the boarder is forced to use the board with only one boot engaged. The free boot and foot must either be located somewhere on the board, dragged on the snow, or elevated above the snow. The result is often an unintended fall, which may also affect adjacent skiers, especially when three or five other riders are on the lift.

With traditional bindings, the complicated strap systems only permitted the boarder to engage the boot with the binding after offloading. Until now, the only available solution for step-in binding equipped boards was to engage the free boot at the precise time of onloading, or during the lift ride, with the later option involving significant risk to the boarder since he or she must reach down to the board, grip it, and pull it upward to have the boot engage the binding. Thus, it is clear that some means for engaging the free boot with the step-in binding must be found to eliminate the realistic potential of an unintended fall after offloading from the lift or the realistic potential of an unintended fall from the lift while trying to grab the board to provide the necessary upward bias so that the step-in bindings could be engaged.

SUMMARY OF THE INVENTION

In view of the foregoing, the invention is directed to an assisting means for permitting a user to provide an upward force to a snowboard so that the user can engage a free boot with the step-in binding. The means does not otherwise interfere with the user's operation of the snowboard or the lift loading and offloading operations. The invention is generally stowable so that when the board is unattended, it cannot be pilfered by other boarders who may be jealous of the assisting means. Moreover, the invention includes provide a safety feature so that if it does become unintentionally engaged with something other than the user or his/her equipment, it will not cause injury to the user.

The invention is intended to provide the desired assisting means and comprises a binding and boot engagement system having a flexible tether including a first portion and a second portion. A snowboard engaging member is attached at the first portion of the tether to engage a portion of the snowboard or binding thereof. Attached to the second portion is a user engaging member to engage a portion of the user or the user's clothing or other attached accessories, whereby the user is tethered to the snowboard via the system. The snowboard engaging member may be as simple as forming a loop with the tether about a portion of the snowboard or binding thereof, or may comprise a hook, a snap, a carabiner, or any other viable means for securing a tether to an object. Similarly, the user engaging member may comprise forming a loop with the tether about a portion of the user, or may comprise a hook, a snap, a carabiner, or any other viable means for securing a tether to an object.

In a preferred embodiment, the first portion of the tether has low strain properties and is intended to be gripped by the user to urge the snowboard towards the user, thereby permitting the user to engage the free boot with the free binding while the user is on an elevated lift. The second portion is preferably resilient or has a retraction bias to otherwise impart a slight tension force in the tether when the system is installed. In this manner, the system will have a slight tension bias so that the tether does not have slack present therein when not being used by the user. Thus, whether the user is fully flexed or fully extended, the tether will have a slight tension bias present, thereby decreasing the likelihood of the tether inadvertently engaging extraneous structures.

There are numerous means for providing a tension bias in the assist system. One possibility is to employ a shock cord or other longitudinally elastic member as the second portion of the tether. Another is to use a helical cord (similar to a telephone handset cord) as the second portion of the tether. Still another possibility is to use a recoil mechanism (similar to a retractable key chain assembly) to recoil the unneeded second portion of the tether. All of these means permit a generally linear extension of the second portion of the tether from the user while maintaining a retraction bias so as to impart tension in the system.

Also present in a preferred embodiment is an escapement connector that links the first portion of the tether to the second portion of the tether. By incorporating such a structure, upon accidental engagement of the system with a structure that is not part of the user or snowboard, the two portions will separate upon exertion of force sufficient to cause separation of the escapement portion. For example, if the tether becomes engaged with a portion of the elevated lift, and the user desires to leave the lift, the escapement portion will separate, thereby creating two free ends which should permit disengagement of the system from the lift.

In addition to the foregoing, a preferred embodiment utilizes an anchor mounted on the snowboard, proximate to the binding, so as to provide a sufficient connection point between the first portion or end of the tether and the snowboard. Naturally, such an anchor is not necessary if the tether is connected to the binding, however, such a mounting system may interfere with the operation and safety of the binding system.

An alternative embodiment further comprises a belt or band, which operates to link the user with the user engaging member of the tether second portion. The belt or similarly attached accessory preferably includes an attachment point to receive the user engaging member. Once the belt or band is securely (but removably) attached to the user, the tether can be attached thereto, thereby linking the user to the tether, which is desirably linked to the snowboard during use of the assisting means or system.

To use the described system, a user will engage the snowboard engaging member to the snowboard, binding, or auxiliary anchor, and engage the user engaging member to the user or user's accessories. Ideally, a slight tension bias will be imparted into the system when the user is in the athletic position, i.e., that position normally assumed during snowboarding activities. The escapement connector, if present, is engaged so as to retain the first portion of the tether with the second portion of the tether. When it is desired by the user to elevate the snowboard so as to engage the boot with the binding, the user need only grasp the first portion of the tether and urge the board toward the user. By centering the free boot above the free binding and applying a lifting force, the binding is brought to bear against the free boot and the boot will then engage.

BRIEF DESCRIPTION OF THE DRAWINGS

FIG. 2 is a perspective view of the embodiment shown in FIG. 1 when not attached to a user and highlighting the incorporation of an anchor to link the tether to a snowboard;

FIG. 3 is an end elevation view in section of the anchor used with the tether showing in particular a preferred means of mounting the anchor to the snowboard.

DETAILED DESCRIPTION OF THE INVENTION

Figure 1:
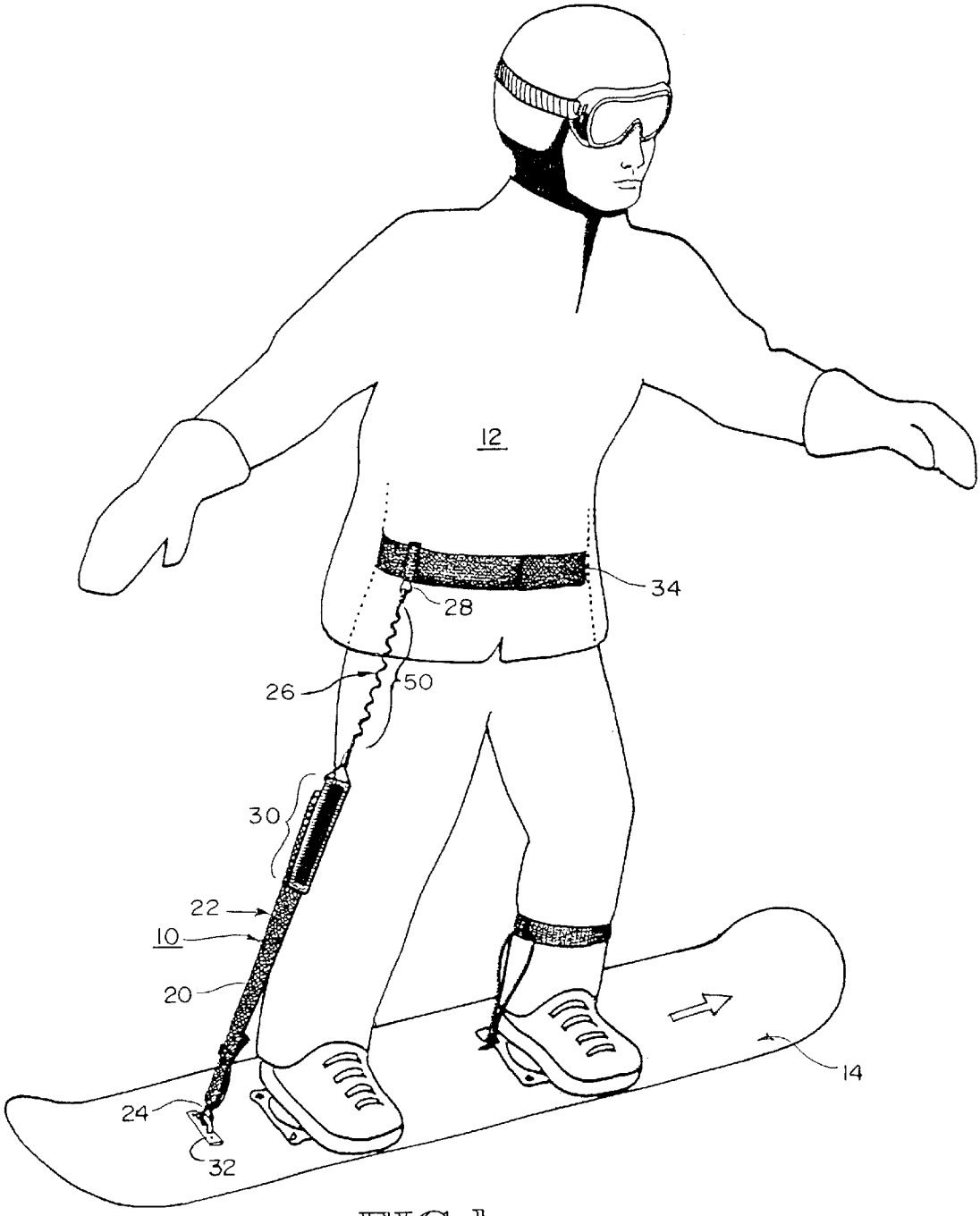
FIG. 1 is a perspective view of a snowboard and user equipped with a first embodiment of the system showing the first and second portions thereof linked by an escapement connector, and linked to a user by a belt.

Turning then to the several Figures wherein like numerals indicate like parts and more particularly to FIG. 1 the components of system 10 are shown. System 10 provides a link between user 12 and snowboard 14, and includes tether 20 having first portion 22 with clip 24 attached thereto, second portion 26 having clip 28 attached thereto, and break-away or escapement connector 30 (alternatively referred to as connector portions 30*a* and 30*b*) to link first portion 22 with second portion 26. Also shown is anchor 32 located at the rear portion of snowboard 14 and optional belt 34 worn by user 12.

Figure 5:
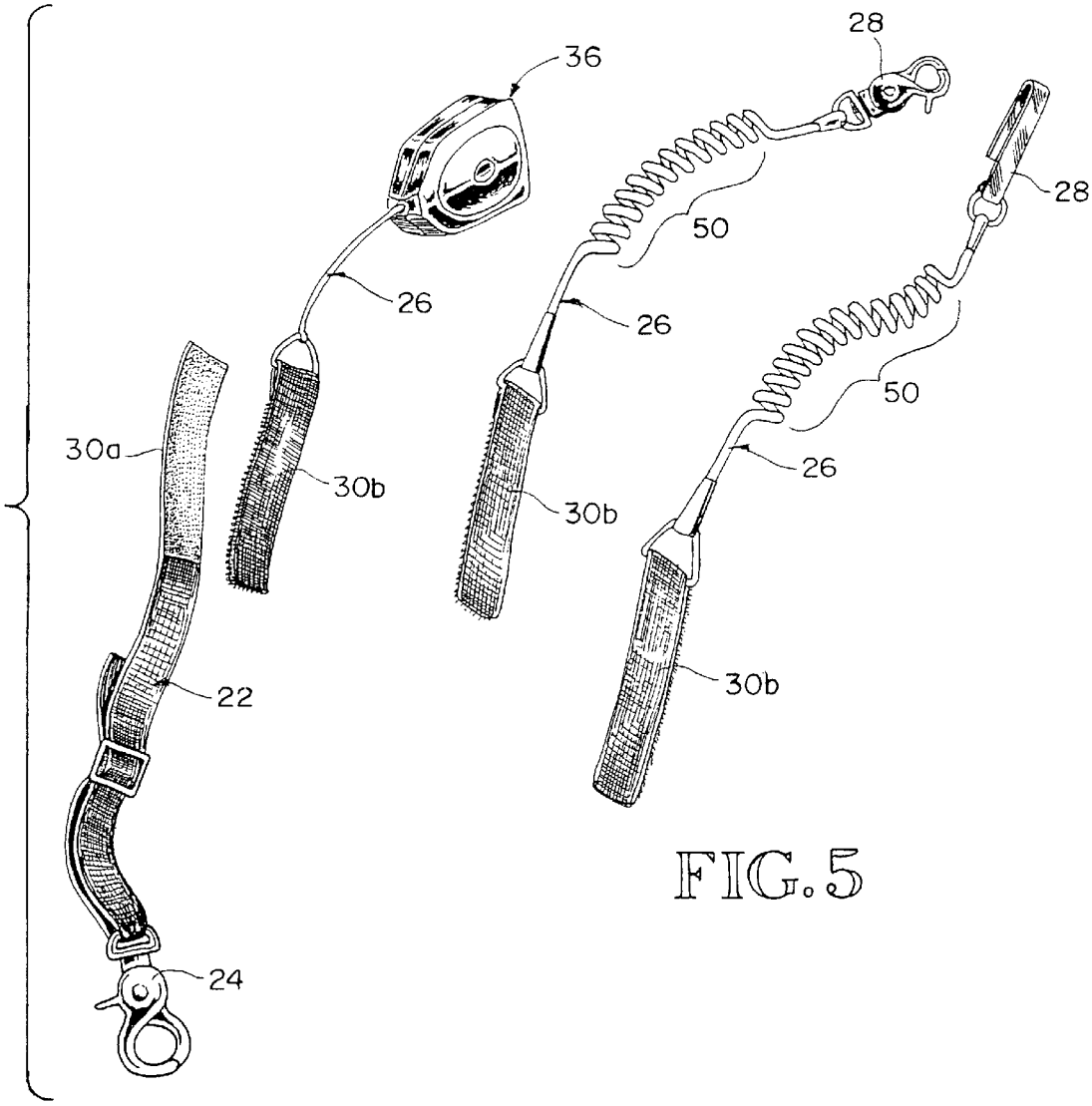
FIG. 5 is a perspective view of the embodiment shown in FIG. 1 further showing interchangeable tether second portions.

Turning to FIG. 5, first portion 22 is preferably constructed from a durable and flexible material such as nylon that has very low strain properties. While first portion 22 will not be subject to substantial tension during operation of system 10 when user 12 is providing an upward bias to snowboard 14, a low stretch material is considered desirable from a usability perspective. Thus, a suitable material can be formed into any tension member including a strap, a web, a cord, a chain, a cable or any other configuration. As shown, clip 24 is securely attached to first portion 22, in this Figure by looping a lower portion of first portion 22 thereabout and self-securing using a buckle. Second portion 26 is preferably constructed from a flexible material having an inherent or applied retraction bias. As illustrated, second portion 26 can include a light gage coiled cable 50, which provides the desired retraction bias. Other materials such as elastic cord (shock cord) may be used, but in view of the harsh environment in which system 10 is intended to operate, it is considered more desirable to avoid material subject to failure in cold and wet environments, as well as degradation when exposed to high levels of ultraviolet radiation common in high altitude environments. Alternatively, separate retraction member 36 may be used, thereby broadening the selection possibilities for the material selection for the second portion of the tether. In either embodiment, second portion 26 is preferably linked to a break-away or escapement connector system 30 which will now be described.

Figure 6:
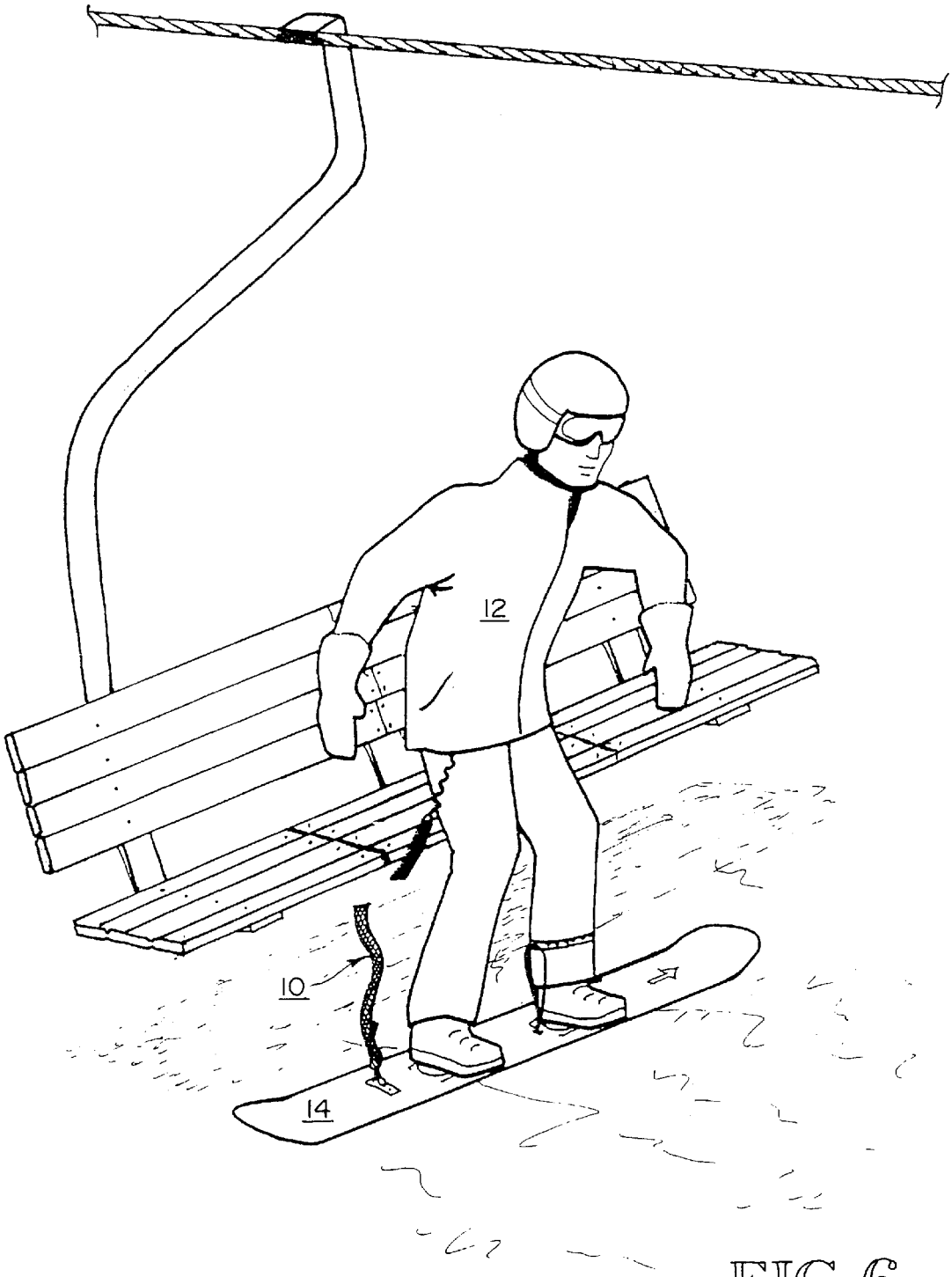
FIG. 6 is a perspective view of a user equipped with the embodiment of FIG. 1 illustrating the release of an escapement device if the tether becomes entangled in an object.

A safety feature of the invention is the incorporation of a two-part break-away or escapement connector 30. Connector portion 30*a*, which is securely associated or integrated with first portion 22 cooperates with connector portion 30*b*, which is securely associated or integrated with second portion 26. Thus, if tether 20 becomes entangled, for instance, in a lift component as best illustrated in FIG. 6, the resulting tension in tether 20 in excess of a predetermined threshold will cause connector 30 to separate. Thereafter, connector portions 30*a* and 30*b* may harmlessly disengage from the source of entanglement.

Figure 1A:
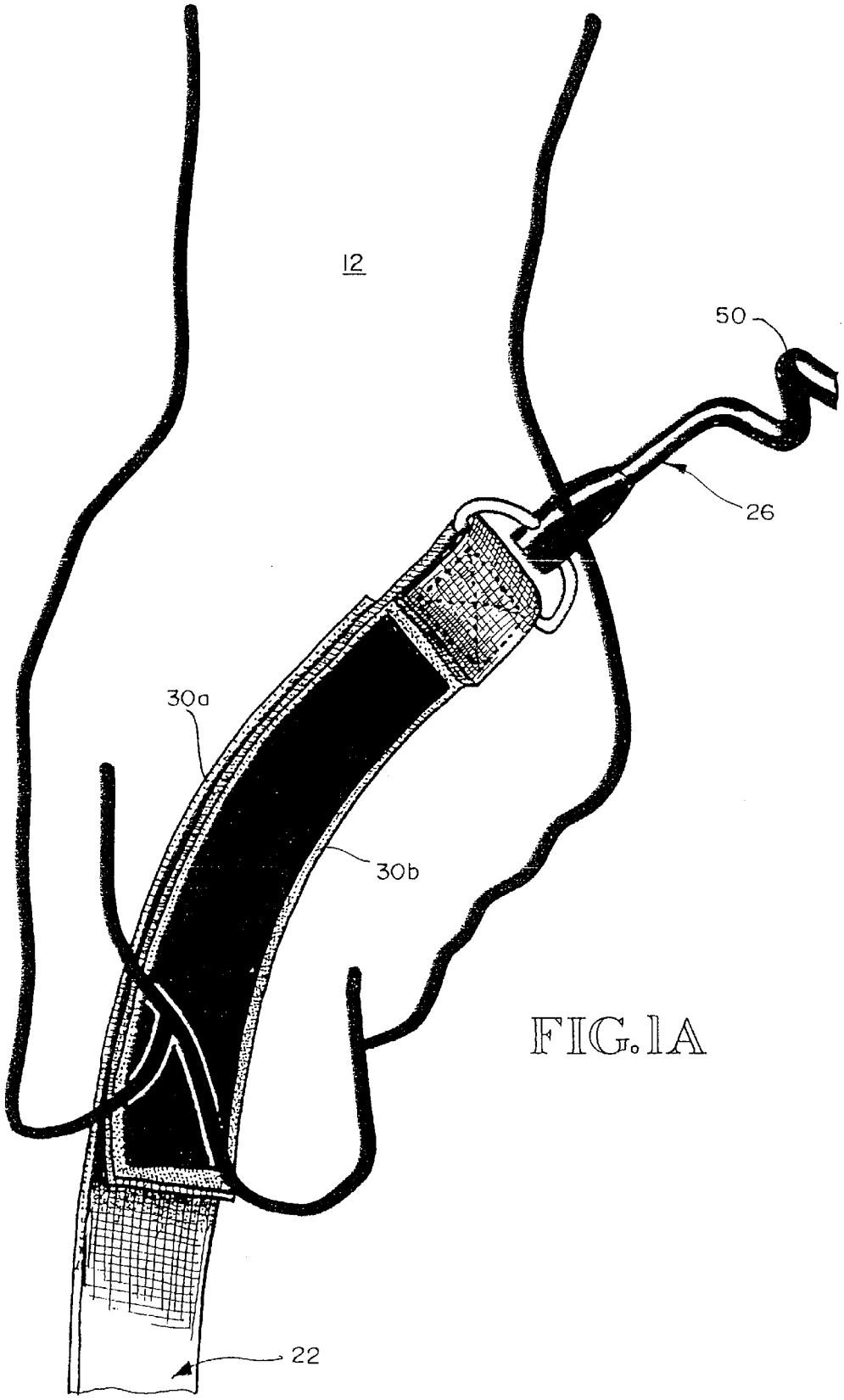
FIG. 1*a* is a perspective partial view of the embodiment shown in FIG. 1 illustrating a user gripping a portion of the tether to elevate the attached snowboard.

In a preferred embodiment illustrated in the several Figures, connector 30 is comprised of a two-part hook and loop fastener system wherein one portion 30*a* is fixedly attached to first portion 22, and one portion 30*b* is fixedly attached to second portion 26. Beneficially, connector 30 also may function as a user grip as is best shown in FIG. 1*a* since it is fixedly attached to first portion 22. If such use is contemplated, then incorporation of grip enhancing member may assist the user in grasping and retaining connector 30.

Those persons skilled in the art will appreciate that numerous types of two part escapement connectors can be used. It is only required that the connector chosen be capable of reuse. Therefore, mechanical friction ball and socket connectors or snap connectors, and even magnetic couplers (two magnets with opposite opposing poles) would be considered suitable alternatives to the disclosed hook and loop fastener system disclosed herein.

Figure 4:
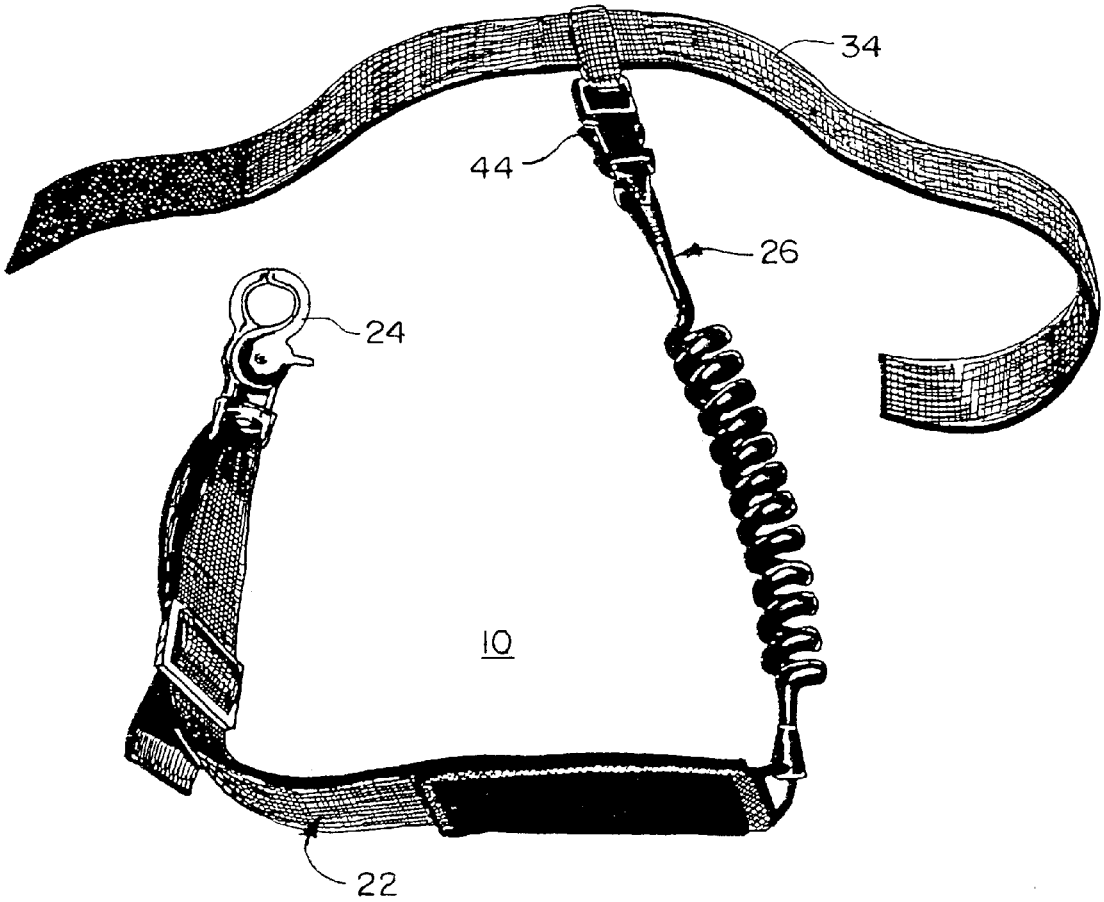
FIG. 4 is a perspective view of the embodiment shown in FIG. 1 when not attached to a user and showing a buckle fastener to link the second portion of the tether to the belt, thereby permitting the user to easily disconnect the tether from the belt.

Turning attention to FIG. 4, it can be seen that by adding a two part buckle system 44 to second portion 26, tether 20 can be temporarily removed from belt 34.

Returning to FIGS. 2 and 3, it can be seen that anchor 32 is fixedly attached to snowboard 14 by way of flanged, threaded collars 46 accepting screws 48. While other means for attaching anchor 32 are proper, such as adhesives, lag screws, and welding, the illustrated means is preferred. Suitable recesses are formed in the base of the snowboard to receive collars 46 so that the base retains a flat gliding surface. By using a through bolt design, the highest level of attachment can be achieved. As will be noted below, this robust embodiment has uses beyond assisting the user with engaging a boot into a binding.

A common problem when participating in commercial downhill winter sports is the theft of one's equipment. To address this all to often problem, area operators often provide ski/board corrals (also know as ski-checks) and locking fixtures for use by area customers. Another alternative has been for the user to carry a small locking device so that the equipment can be secured to any nearby fixture. However, with click-in or step-in snowboard bindings, there is little available exposed hardware wherein a user can secure a locking device. To provide such a resource, anchor 32 can be used after removal of tether 20.

To prevent the clever thief from merely detaching anchor 32 from board 14, numerous removal prevention means can be used. Examples of such means include one-way screws, screws having uncommon drive head configurations (hex head, TORX® head, spanner head, etc.), and physical barriers applied to anchor 32 after attachment by conventional means.

What is claimed:

1. A binding and boot engagement system for use in conjunction with a gliding platform having a step-in binding system comprising:

a flexible tether having a discrete first portion, which includes a first end and a second end;

a first engaging member linked to the first end of the first portion for linking the first portion to the gliding platform;

a second engaging member at the first end of the second portion for linking the second portion to the user; and an escapement connector including a hook and a loop that engage each other to removably link the first and second portions of the flexible tether to each other, wherein the hook and loop will disengage when the escapement connector encounters an axial force exceeding a predetermined threshold.

2. The system of claim 1 wherein the system further comprises a torso belt to be worn by a user and adapted to engage the second engaging member.

3. The system of claim 1 wherein the first engaging member links the first portion to a binding mounted to the gliding platform.

4. The system of claim 1 wherein the first engaging member links the first portion to the gliding platform.

5. The system of claim 1 further comprising an anchor fixedly attached to the gliding platform to receive the first engaging member.

6. The system of claim 1 further comprising an anchor fixedly attached to a binding to receive the first engaging member.

7. The system of claim 1 wherein the first portion of the tether has low strain properties and the second portion of the tether has strain properties greater than the first portion.

8. The system of claim 7 wherein the second portion of the tether is elastically extensible.

9. The system of claim 7 wherein the second portion of the tether is a linear material having a generally permanent coil form.

10. The system of claim 7 wherein the second portion of the tether is a linear material having inherent longitudinal extension and retraction properties.

11. The system of claim 1 further comprising a recoil member linked to the second portion of the tether to provide a retraction bias to create tension in the first portion.

12. The system of claim 11 wherein the recoil member includes the user engaging member.

13. The system of claim 1 further comprising an anchor attached to the gliding platform.

14. The system of claim 1 wherein the tether is of sufficient length to extend from the gliding platform to a torso portion of the user when worn by the user.

15. A method for engaging a user's free boot with an available step-in binding mounted to a gliding platform comprising the steps of:

a) linking a first portion of a flexible tether to the platform;

b) linking a second portion of the flexible tether to the user;

c) removably linking the first and second portions of the flexible tether together with an escapement connector that includes a hook and loop;

d) elevating the platform from a supporting surface;

e) positioning the free boot above the step-in binding; and f) applying a tension force to the tether whereby the board elevates towards the user, thereby permitting engagement of the free boot with the step-in binding.

16. The method of claim 15 wherein the tether comprises a first portion and a second portion and the second portion applies a tension bias to the first portion after step b).

* * * * *

UNITED STATES PATENT AND TRADEMARK OFFICE

CERTIFICATE OF CORRECTION

PATENT NO. : 6,702,328 B2 
DATED : March 9, 2004
INVENTOR(S) : Joseph A. Malleis and Laurence L. Malleis It is certified that error appears in the above-identified patent and that said Letters Patent is hereby corrected as shown below:

Column 6,
Line 17, insert the following before the semi-colon: -- , and a discrete second portion, which includes a first end and a second end --
Line 52, delete the word "user" and insert the word -- second --.

Signed and Sealed this

Twenty-fifth Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,702,328 B2
APPLICATION NO. : 09/810699
DATED : March 9, 2004
INVENTOR(S) : Malleis et al.

It is certified that error appears in the above-identified patent and that said Letters Patent is hereby corrected as shown below:

Col. 6, at line 10, insert the following just before the semi-colon: “, and a discrete second portion, which includes a first end and a second end”

Signed and Sealed this

Eighteenth Day of July, 2006

JON W. DUDAS
*Director of the United States Patent and Trademark Office*